United States Patent [19]

Luke

[11] Patent Number: 4,583,558

[45] Date of Patent: Apr. 22, 1986

[54] MARKING OF SMOKING ARTICLE WRAPPINGS

[75] Inventor: John A. Luke, Eastleigh, England

[73] Assignee: British-American Tobacco Company Limited, London, England

[21] Appl. No.: 590,203

[22] Filed: Mar. 16, 1984

[30] Foreign Application Priority Data

Mar. 29, 1983 [GB] United Kingdom ..... 8308531

[51] Int. Cl.[4] ..... A24C 5/60

[52] U.S. Cl. ..... 131/284; 131/365

[58] Field of Search ..... 131/284, 365

[56] References Cited

U.S. PATENT DOCUMENTS 2,193,439 3/1940 Van Doren ..... 131/365

4,366,826 1/1983 Horsewell ..... 131/365

*Primary Examiner*—V. Millin

*Attorney, Agent, or Firm*—Kane, Dalsimer, Kane, Sullivan and Kurucz

[57] ABSTRACT

A method of marking a smoking-article exterior wrapping, particularly a cigarette wrapping, in which the wrapping, comprising a substance which causes or undergoes a permanent change of color under the action of the application or transmission of energy, is subjected to energy over an area of a conformation corresponding to the required marking, whereby a color change is caused over the area. The energy transmission may advantageously take the form of heat conduction. Alternatively, the energy transmission may take the form of electromagnetic or corpuscular radiation or irradiation.

The wrapping and a heated former of conformation may be brought into contact with each other or may be maintained in contact with each other under pressure. The wrapping may already form part of a smoking article when wrapping is being subjected to energy transmission. The smoking article may in this case be rolled about the longitudinal axis thereof in contact with a former, which may mould an impression into wrapping. The method is advantageously performed on a filter-tip assembling machine.

The wrapping may be tipping wrapping composed at least substantially wholly of cellulose fibres or comprise a major proportion of polypropylene fibres and a minor proportion of cellulose fibres.

A smoking article according to the invention may comprise a wrapping bearing a marking which has been produced by wrapping having been subjected to energy transmission to effect a color change of said wrapping.

9 Claims, 3 Drawing Figures

MARKING OF SMOKING ARTICLE WRAPPINGS

This invention relates to the marking of smoking-article wrappings and to smoking articles comprising marked wrappings.

The marking of exterior wrappings of cigarettes is a well established practice. For example, brand names are commonly printed in ink on cigarette paper. Such printing usually takes place as part of cigarette manufacture, a printing unit being mounted on the cigarette-making machine. Another common example of the marking of cigarette wrappings is the application to a web of tipping paper of dyes in such a manner as to produce a cork-tipping effect.

It is an object of the present invention to provide a simple and flexible method of marking a wrapping of a smoking article, which method may, if required, be carried out on article-making machinery and which produces the marking otherwise than by printing it in ink.

The invention provides a method of marking an exterior wrapping of a smoking article in which the said wrapping, provided with a substance which causes a permanent change of colour under the action of the transmission of energy, for example and advantageously thermal energy, is subjected to energy transmission over an area of a conformation corresponding to the required marking, to cause a colour change over the said area.

The exterior wrapping may be the cigarette paper or the tipping of a cigarette.

Although the method according to the invention may be carried out on the wrapping before a reel thereof is mounted on a smoking-article making machine, or after the reel has been so mounted but before the wrapping has been incorporated with a smoking article, advantageously the wrapping is incorporated with a smoking article when the method is carried out on the wrapping. The energy transmission preferably takes the form of heat conduction and most suitably the smoking article is rolled in contact with a heated former means in a direction transverse to the axis of the smoking article. The degree of colour change caused may then be controlled according to the temperature to which the wrapping is raised by the heated former means.

The method according to the invention may be carried out, if desired, in such manner that a heated former means moulds an impression into the wrapping, as well as causing a colour change of the colour-change substance with which the wrapping is provided. When such a moulded impression is required, the wrapping may be one comprising a thermoplastic material, a polyolefin for example.

In the manufacture of filter-tipped cigarettes it is the current practice to assemble in line a double length filter element with two tobacco rods, inner ends of which rods abut respective ends of the filter element.

A tipping wrapper is then applied to such assembly, the wrapping serving to enwrap the full length of the filter element and a short length of each of the tobacoo rods and thus to interattach the filter element and the rods. Subsequently, the double cigarette assembly is severed at the central transverse plane of the filter element thus to provide two completed filter tipped cigarettes. These steps are carried out on a machine called a filter-tip assembling machine. In the operation of such machine, a leading end of a discrete tripping wrapping being conveyed on a rotary drum, called a cork drum, is adhered, by adhesive applied to the tipping wrapping, to a rod-filter element-rod assembly being conveyed by another drum, called a transfer drum. The assembly is then transferred onto the cork drum. Disposed in spaced relationship with the cork drum is a curved, heatable rolling plate the purpose of which is to cause each assembly to be rotated about its axis as it is conveyed by the cork drum and thus to cause the tipping wrapping to be wrapped completely about the assembly. In carrying out the method according to the invention, an advantageous location for a heated former means is at or adjacent to the roller plate.

The colour-change substance with which the wrapping is provided may be incorporated into the "furnish" at the stage of manufacturing the wrapping, but is more conveniently applied, at the side intended to be the outer side upon incorporation with a smoking article, after manufacture. The substance on the wrapping may, before being caused to change colour, be coloured, white or colourless.

The marking on the wrapping, as for example if it takes the form of a brand name or emblem or similar such indicia, may extend over only a minor proportion of the circumference of the smoking article such that it may be seen in its entirety without the article having to be turned about its axis. On the other hand, the marking may take the form of a decoration or pattern extending or being repeated over the full circumference of the smoking article. Such decoration or pattern may comprise lines extending around or lengthwise of the article. In order to provide such decoration or pattern on a smoking article after manufacture thereof it is necessary to roll the article through a complete revolution in contact with the heated former means.

A continuous, ostensibly random pattern, such for example as the well known cork tipping-effect pattern, can be produced using the method according to the present invention. The pattern could be applied to finished smoking articles or to a wrapping web prior to the incorporation thereof with a smoking article. In the latter case, if a heated former is used, it could be of the form of a roller carrying the desired pattern at the peripheral surface thereof. If required, the pattern could be thermally impressed into the wrapping. Should thermal impressment be required when using a heated roller, it could be advantageous to pass the wrapping through a nip formed between a heated roller and a contact roller having a resilient peripheral surface.

The present invention also provides a smoking article, a cigarette for example, comprising a wrapping bearing marking which has been produced or enhanced by said wrapping having been subjected to energy transmission to effect a colour change of wrapping or of a substance with which said wrapping was provided.

BRIEF DESCRIPTION OF THE DRAWINGS

Ways of putting the invention into practice will now be more fully described by way of example with reference to the accompanying diagrammatic drawings in which FIG. 1 is an end view of part, namely a quadrant of the circumference of the rolling plate of a filter-tip assembling machine of known kind referred to above. For the present invention a brand-name printing die 1 is let into the rolling face 2 of the rolling plate 3 which coacts with a rotating printing drum, the "cork drum", 6 for producing a double-length cigarette filter cigarette assembly such has been referred to above. These are in fact identical dies 7, one for each cigarette of the double assembly. The contact faces 1' of the dies 1 are flush with the rolling fascia. The dies are separated from the surrounding metal of the plate 3 by a linear 4 of thermal insulating material. Each die 1 is provided with heating means in the form of an electrical resistance heating unit 5. The rolling plate 3 is heated by separate known heating means (not shown), to a lower temperature than the dies, to promote setting of the tipping-wrapping adhesive.

Figure 1:
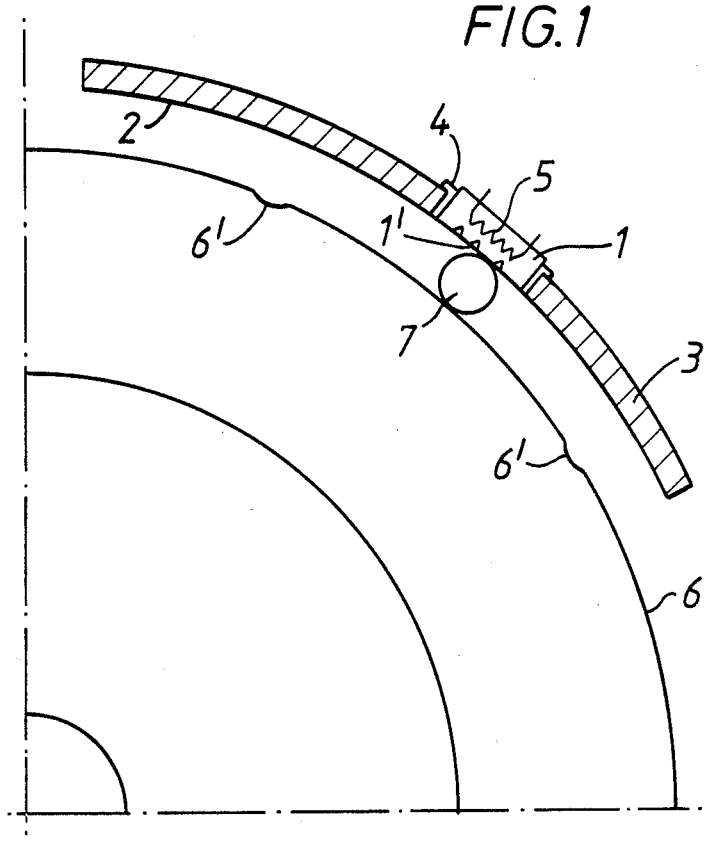
FIG. 1 is an end view of the circumference of the rolling plate of a filter-tip assembling machine.

It will be noted that the surface of the drum 6 has shallow flutes 6' at intervals, to which reference will be made thereinafter.

For the use of the apparatus described above, a reel of tipping wrapping was mounted on the filter-tip assembling machine. The fibrous content of this wrapping was substantially wholly composed of cellulosic fibres. The wrapping bore an overall dyed pattern providing a cork-tipping effect. Double-length filter elements and unit-length tobacco rods were fed to the machine, which was operated to interattach the said elements and tobacco rods by means of discrete tipping wrappings severed from the web extending from the aforesaid reel. the double-length cigarettes where then severed by a disc knife of the assembling machine to provide single cigarettes.

It was observed that the tipping of each cigarette, where it had been contacted by one of the heated dies, bore a marking in the form of a distinct, sharp-edged, representation of the brand name. the colour of the markings, resulting from heating of the cork-effect dye by the heated printing dies, was significantly darker than that of the surrounding wrapping material which, although having been subjected to heating by the heated rolling plate, had not been raised to a sufficient temperature to cause a colour change of the dye.

Thus, as is usual with such an arrangement, the cigarette or cigarette assembly 7 is caused to roll, in known manner over the surface 2 of the plate 3.

In another test, using the same machine with a tipping wrapping which contained 75% polypropylene fibres and 25% cellulosic fibres was provided with a similar cork-effect appearance. Two brand-name printing dies 1 were let into the rolling plate 3, but the contact face of each die was not flush with the rolling surface 2, but proud of the surface by 1 mm. The tipping wrappings of the cigarettes asembled by the machine each bore a representation of the brand name, but in this case not only was the brand name depicted sharply in colour-changed dye, but also in three dimensions, by virtue of its having been thermally impressed into the wrapping.

These methods according to the invention, when applied to mark tipping wrappings, possess advantages over the current procedure of printing a pattern or decoration onto a tipping wrapping before a reel thereof is mounted on a filter-tip assembling machine. The printing procedure can only be used satisfactorily to print an overall pattern or a decoration continuously along the length of the wrapping web. If discrete markings, emblems for example, were spaced apart at regular intervals along the wrapping web, then in use of that web, the severance thereof to provide discrete tipping wrappings could sometimes take place along a line intersecting an emblem. Because of overlapping of the wrapping at the seam therein, the two portions of the emblem could be dislocated and the result unsightly. When, on the other hand, methods according to the present invention are used to produce a marking such as an emblem on tipping wrappings, whether or not the marking is thermally impressed into the wrappings, the marking is applied completely, i.e. without possibility of relative dislocation of portions thereof, even if a portion of the marking extends onto or completely across the lap seam of a tipping wrapping.

When a method according to the present invention is carried out in order to reproduce brand names, emblems or other markings on cigarette papers of assembled cigarettes, it is again significantly advantageous as compared with the known method of utilizing a printing unit mounted on a cigarette-making machine to print markings on the cigarette-paper web upstream of the point of entry thereof into the garniture of the machine. With the printing method, constant attention must be paid to keeping the printing unit clean and clear of build-ups of ink in order to ensure maintenance of distinct printed markings free of smudging. If the cigarette-paper web breaks during operation of the making machine, it may be necessary for the operator to re-thread the web around a number of rollers of the printing unit. Adjustments are required from time-to-time to correct for mislocation of the printed marks along the cigarettes. By use of the present invention, defects of the known method are avoided or reduced.

Although, as described above, the invention is carried out by conducting heat to a colour-change substance by contact with a heated former means, the invention may also be put into effect by using a substance which can be caused to change colour appreciably when subjected to electromagnetic or corpuscular irradiation.

A cigarette wrapper for example may be irradiated through an aperature of a desired conformation or a laser may be used to produce a line along a cigarette wrapper, the laser being moved over the surface of the wrapper along a predetermined path under appropriate control.

It is also within the scope of the present invention to use in a wrapping two or more substances which, when subjected to energy transmission by conduction or radiation, react with one another or each other to produce a colour change.

Figure 2:
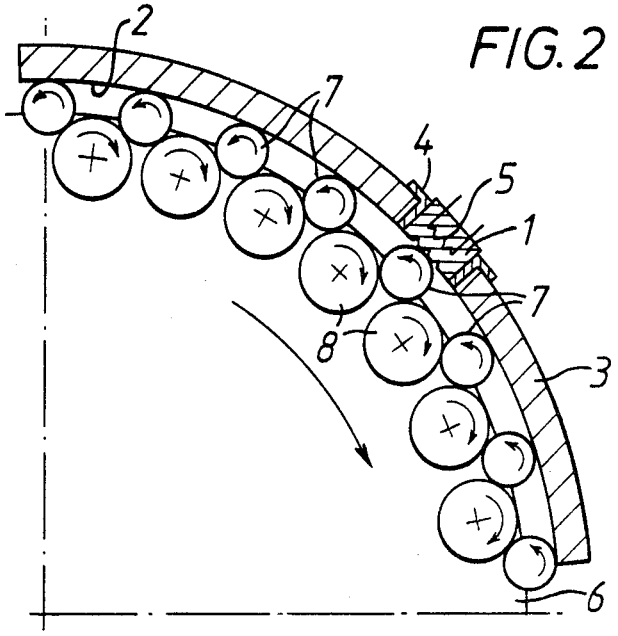
FIG. 2 is an alternate end view of the circumference of the rolling plate of a filter-tip assembling machine.

As above described, printing dies 1 were let into the rolling plate 3 of a filter-tip assembling machine and double-length cigarette assembles 7 were rolled over the dies under action of the rotation of a cork drum 6. As is usual with this arrangement of cork drum and rolling plate, the cigarette assemblies are initially each held in one shallow flute 6' of the drum, possibly under the action of an applied partial vacuum, and roll along the drum surface to be received in a second such flute 6'. In an alternative to this arrangement shown in FIG. 2 a drum 6 is provided in the periphery with a series of rollers 8 whose axes are mounted parallel to the axis of the drum. The spacing of these rollers is such that cigarettes or double-length cigarette assemblies 7 can be supported by pairs of adjacent rollers 8. The rollers 8 are positively driven to rotate and cause the cigarettes or assemblies 7 to be rotated as they pass across the faces of or each heated die 1. This alternative form of drum could be mounted on a filter-tip assembling machine or could constitute a separate unit.

Figure 3:
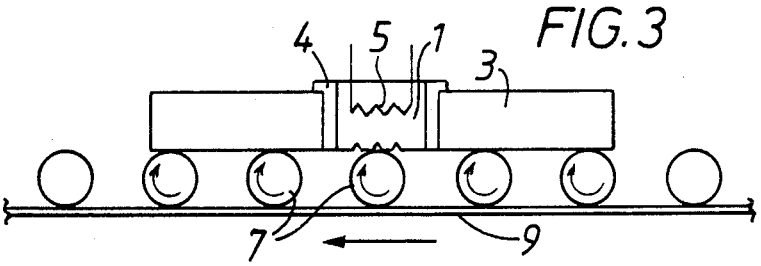
FIG. 3 illustrates the conveying of the cigarettes past the heating die in a straight line in lieu of the curved path illustrated in FIGS. 1 and 2.

A further alternative illustrated in FIG. 3 is to convey the cigarettes or assemblies 7 in a straight line, not a curved path, as they are rolled into contact with a heated die. An endless belt 9, for example, may be used for the straight-line conveyance.

What is claimed is:

1. A method of marking a smoking-article having an exterior wrapping consisting of, or incorporating, a substance which causes or undergoes a permanent change of colour under the application of heat, the method being characterized by bringing the article and a heated former means into contact with each other, the former means corresponding to the required marking, whereby heat applied through the former means to the article effects said colour change.

2. A method according to claim 1, wherein said wrapping and the heated former are maintained in contact with each other under pressure.

3. A method according to claim 1, wherein said smoking article is rolled about the longitudinal axis thereof in contact with a former means.

4. A method according to claim 3, wherein said former means moulds an impression into said wrapping.

5. A method according to claim 1, wherein the method is performed on a filter-tip assembling machine.

6. A method according to claim 1, wherein said wrapping is a tipping wrapping.

7. A method according to claim 1, wherein the wrapping is composed at least substantially wholly of cellulose fibres.

8. A method according to claim 1, wherein the wrapping comprises a major proportion of polypropylene fibres and a minor proportion of cellulose fibres.

9. A smoking article comprising a wrapping bearing a marking which has been produced by said wrapping having been subjected to energy transmission to effect a colour change in said wrapping according to claim 1.

* * * * *